US008164255B2

(12) United States Patent
Kim et al.

(10) Patent No.: US 8,164,255 B2
(45) Date of Patent: Apr. 24, 2012

(54) INORGANIC LIGHT EMITTING DISPLAY WITH FIELD EMISSION LAYER

(75) Inventors: Yoon-Jin Kim, Suwon-si (KR); Jae-Myung Kim, Suwon-si (KR); Hee-Sung Moon, Suwon-si (KR); Mun-Ho Nam, Suwon-si (KR); Hyoung-Bin Park, Suwon-si (KR); Seung-Hyun Son, Suwon-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 302 days.

(21) Appl. No.: 12/026,684

(22) Filed: Feb. 6, 2008

(65) Prior Publication Data

US 2008/0224609 A1 Sep. 18, 2008

(30) Foreign Application Priority Data

Mar. 13, 2007 (KR) ..... 10-2007-0024695

(51) Int. Cl.
*H05B 33/02* (2006.01)
*H05B 33/14* (2006.01)

(52) U.S. Cl. ..... 313/509; 313/506; 313/311

(58) Field of Classification Search ..... 313/506, 313/509, 309–311, 495
See application file for complete search history.

(56) References Cited

U.S. PATENT DOCUMENTS

| | | | | |
|---|---|---|---|---|
| 5,430,300 | A * | 7/1995 | Yue et al. | 250/423 F |
| 6,674,234 | B2 * | 1/2004 | Kim et al. | 313/506 |
| 2001/0047980 | A1 * | 12/2001 | McNallan et al. | 216/75 |
| 2003/0042850 | A1 * | 3/2003 | Bertram et al. | 313/504 |
| 2004/0174117 | A1 * | 9/2004 | Han | 313/506 |
| 2005/0218789 | A1 * | 10/2005 | Seon | 313/497 |
| 2006/0012304 | A1 * | 1/2006 | Son et al. | 313/586 |
| 2006/0097615 | A1 * | 5/2006 | Tsakalakos et al. | 313/309 |
| 2007/0024177 | A1 * | 2/2007 | Choi et al. | 313/495 |
| 2007/0096645 | A1 | 5/2007 | Son et al. | |
| 2007/0103078 | A1 * | 5/2007 | Son et al. | 313/587 |
| 2007/0210704 | A1 * | 9/2007 | Park et al. | 313/506 |
| 2008/0100195 | A1 * | 5/2008 | Kim et al. | 313/495 |
| 2008/0169749 | A1 * | 7/2008 | Kim et al. | 313/498 |
| 2008/0278062 | A1 * | 11/2008 | Moon et al. | 313/498 |

FOREIGN PATENT DOCUMENTS

| | | |
|---|---|---|
| KR | 2001-54537 | 7/2001 |
| KR | 2005-37180 | 4/2005 |
| WO | WO 2006113424 A2 * | 10/2006 |

OTHER PUBLICATIONS

Office Action issued in corresponding Korean Patent Application No. 2007-0024695 dated Jan. 31, 2008.

* cited by examiner

*Primary Examiner* — Karabi Guharay
(74) *Attorney, Agent, or Firm* — Lee & Morse, P.C.

(57) ABSTRACT

An inorganic light emitting display including: a first electrode; a second electrode facing the first electrode; a light emitting layer disposed between the first electrode and the second electrode; and an field emission layer disposed between the light emitting layer and the second electrode.

12 Claims, 2 Drawing Sheets

INORGANIC LIGHT EMITTING DISPLAY WITH FIELD EMISSION LAYER

CROSS-REFERENCE TO RELATED APPLICATION

This application claims the benefit of Korean Application No. 2007-24695, filed Mar. 13, 2007, in the Korean Intellectual Property Office, the disclosure of which is incorporated herein by reference.

BACKGROUND OF THE INVENTION

1. Field of the Invention

Aspects of the present invention relate to an inorganic light emitting display.

2. Description of the Related Art

Recently, research has been conducted on inorganic light emitting displays in a wide variety of areas. Conventional inorganic light emitting displays are disclosed in U.S. Pat. Nos. 5,543,237 and 5,648,181. The disclosed inorganic light emitting display is configured as shown in FIG. 1.

An indium tin oxide (ITO) electrode 2 is formed on a substrate 1, and a first dielectric layer 3 is formed on the ITO electrode 2. An inorganic light emitting layer 4 is formed on the first dielectric layer 3, and a second dielectric layer 5 and a rear electrode 6 are sequentially stacked on the inorganic light emitting layer 4. The stacked structure is isolated from external influences by a passivation layer (not shown) formed on the rear substrate 6.

The inorganic light emitting display is driven by an alternating current (AC) source and forms an image by colliding electrons, accelerated by a high electric field, with the inorganic light emitting layer 4, to excite the inorganic light emitting layer 4; and by allowing the excited light emitting layer 4 to be stabilized to produce visible light. Accordingly, since a large number of electrons should be accelerated at a high energy to achieve a high efficiency, the inorganic light emitting display has the disadvantage of requiring a high driving voltage.

Also, since plasma display panels (PDPs), which have recently attracted much attention, require energy sufficient to ionize a discharge gas, PDPs have the disadvantages of requiring a high driving voltage and having low luminous efficiency.

SUMMARY OF THE INVENTION

Aspects of the present invention provide an inorganic light emitting display having a significantly reduced driving voltage.

According to aspects of the present invention, there is provided an inorganic light emitting display comprising: a first electrode and a second electrode facing each other; a light emitting layer interposed between the first electrode and the second electrode; and a field emission layer interposed between the light emitting layer and the second electrode.

According to aspects of the present invention, the first electrode may be an anode, and the second electrode may be a cathode. The light emitting layer may be made of an inorganic material. The light emitting layer may include quantum dots.

According to aspects of the present invention, the inorganic light emitting display may further comprise: a first dielectric layer interposed between the first electrode and the light emitting layer; and a second dielectric layer interposed between the second electrode and the light emitting layer. The field emission layer is disposed between the second dielectric layer and the second electrode.

According to aspects of the present invention, the field emission layer may include a carbide-derived carbon, an oxidized porous silicon, or a boron nitride bamboo shoot (BNBS). The carbide-derived carbon may be formed using a carbon precursor. The carbon precursor can be any one selected from the group consisting of: a diamond-like carbide, such as, SiC or $B_4C$; a metal-like carbide, such as, TiC or $ZrC_x$; a salt-like carbide, such as, $Al_4C_3$ or $CaC_2$; a complex carbide, such as, $Ti_xTa_yC$ or $Mo_xW_yC$; and a carbonitride, such as, $TiN_xC_y$ or $ZrN_xC_y$.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become more apparent and more readily appreciated from the following description of the embodiments, taken in conjunction with the accompanying drawings in which.

DETAILED DESCRIPTION OF THE EMBODIMENTS

Figure 1:
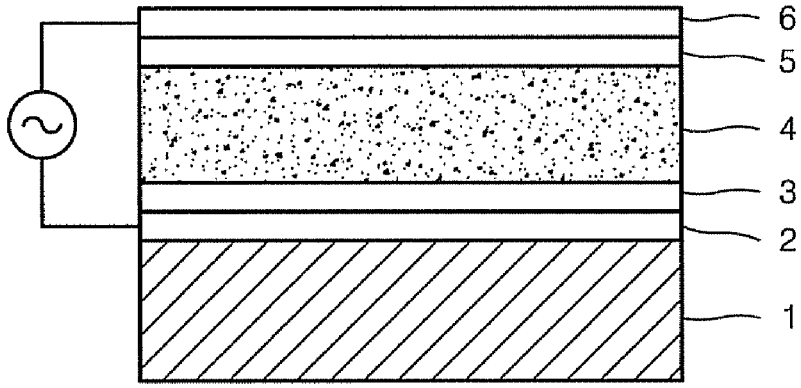
FIG. 1 (CONVENTIONAL ART)
FIG. 1 is a cross-sectional view of a portion of a conventional inorganic light emitting display.

Reference will now be made in detail, to exemplary embodiments of the present invention, examples of which are illustrated in the accompanying drawings, wherein like reference numerals refer to the like elements throughout. The exemplary embodiments are described below, in order to explain the aspects of present invention, by referring to the figures.

It will be understood that when a layer or element is referred to as being disposed "on" another layer or substrate, it can be directly on the other layer or substrate, or intervening layers may also be present. Further, it will be understood that when a layer is referred to as being disposed "under" another layer, it can be directly under, and one or more intervening layers may also be present. In addition, it will also be understood that when a layer is referred to as being disposed "between" two layers, it can be the only layer between the two layers, or one or more intervening layers may also be present.

Figure 2:
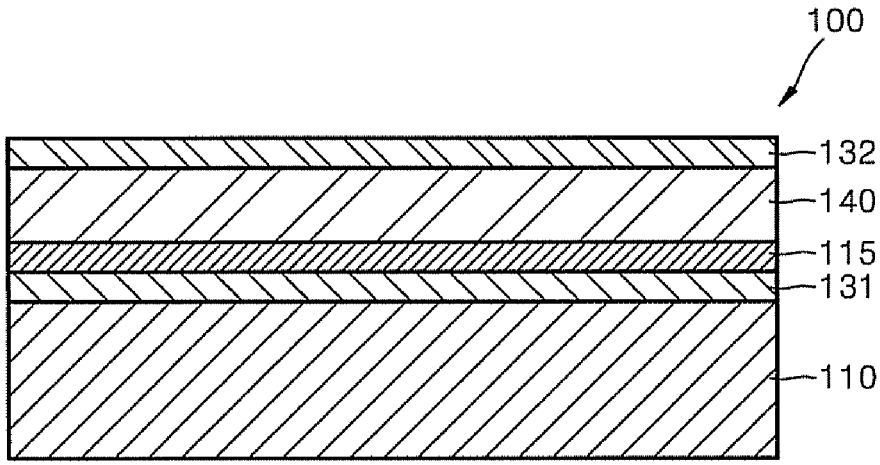
FIG. 2 is a cross-sectional view of a portion of an inorganic light emitting display, according to an exemplary embodiment of the present invention.

FIG. 2 is a cross-sectional view of a portion of an inorganic light emitting display 100, according to an exemplary embodiment of the present invention. Referring to FIG. 2, the inorganic light emitting display 100 includes a substrate 110, a first electrode 131, a second electrode 132 facing the first electrode, a light emitting layer 115 disposed between the first electrode 131 and the second electrode 132, and a field emission layer 140 disposed between the light emitting layer 115 and the second electrode 132. The substrate 110 may be made of a glass having a high visible light transmittance, and may be colored to improve contrast. The substrate 110 may be made of a plastic, or a flexible, thin metal film.

The first electrode 131 may be made of a transparent conductive material, such as indium tin oxide (ITO), and may be patterned by photolithography. The first electrode 131 may be connected to a first external electrode terminal (not shown), to act as an anode. The second electrode 132 may be a reflective electrode made of aluminum or calcium, and may be connected to a second external electrode terminal (not shown), to act as a cathode. The first electrode 131 and the second electrode 132 may have opposite polarities. For convenience, it is assumed herein that the first electrode 131 is an anode and the second electrode 132 is a cathode.

The light emitting layer 115, interposed between the first electrode 131 and the second electrode 132, can be made of a metal sulfide such as ZnS, SrS, or CaS, an alkali earth potassium sulfide such as $CaGa_2S_4$ or $SrGa_2S_4$, transition metal, for example, Mn, Ce, Tb, Eu, Tm, Er, Pr, or Pb; or an alkali rare-earth metal. The light emitting layer 115 produces visible light due to the collision of electrons thereon, which will be explained later. The light emitting layer 115 may be made of an inorganic material. However, the present embodiment is not limited thereto. The light emitting layer 115 may include quantum dots. The properties of quantum dots will now be explained.

Since a solid light emitting material includes a great number of atoms, energy bands are formed therein. When electrons excited by an external energy are stabilized and drop from a conduction band to a valence band, visible light having a wavelength corresponding to the difference in energy, between the conduction band and the valence band, is produced. In the case of quantum dots, there is no interference between the atoms, and when supplied with external energy, electrons excited at the atomic level are stabilized to produce visible light. Accordingly, since quantum dots can theoretically realize a 100% quantum efficiency, the excitation can be achieved at a low voltage, and a luminous efficiency can be improved. Also, since the light emitting layer 115 can be formed using a printing process, a large display can be achieved.

Figure 3:
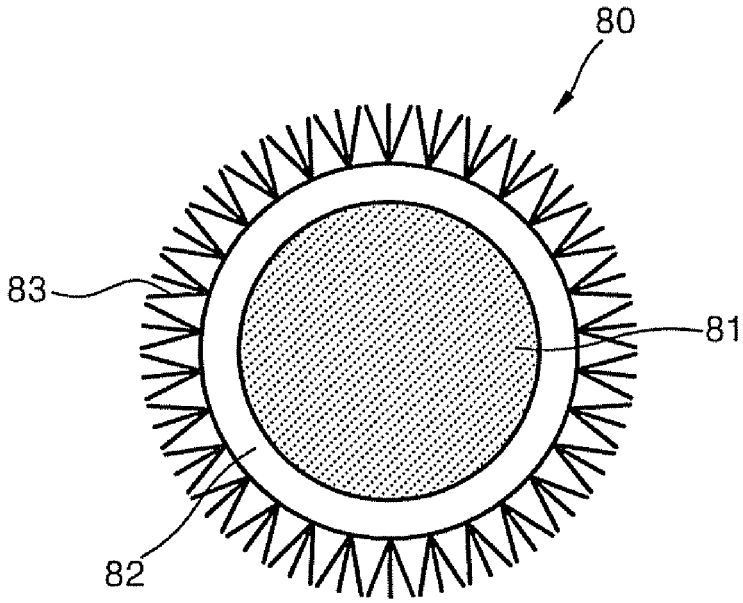
FIG. 3 is an illustration of a quantum dot.

FIG. 3 illustrates a quantum dot 80. Referring to FIG. 3, the quantum dot 80 includes a CdSe core 81, a ZnS shell 82 surrounding the core 81, and trioctylphosphine oxide (TOPO) caps 83 to structurally supporting the core 81 and the shell 82. The quantum dot 80 may have either a single-layered structure or a multi-layered structure. The quantum dot 80 may have a single-layered structure to achieve a higher luminous efficiency.

Referring again to FIG. 2, the field emission layer 140, which is disposed between the light emitting layer 115 and the second electrode 132, may be made of any material capable of accelerating electrons. In particular, the field emission layer 140 may include a carbide-derived carbon, an oxidized porous silicon, or a boron nitride bamboo shoot (BNBS).

To form the field emission layer 140 including carbide-derived carbon, a carbon precursor, e.g., a metal carbide, is prepared in a halogen gas atmosphere, e.g., $Cl_2$, using a high temperature graphite furnace. Metal is removed from the carbon precursor by a high temperature thermochemical reaction, thereby obtaining porous carbon. For example, 100 g of $\alpha$-SiC, having a mean diameter of 0.7 μm, may be prepared as a carbon precursor in a high temperature furnace. The high temperature furnace can comprise a graphite reaction chamber, a transformer, etc. 0.5 liters of $Cl_2$ gas may be supplied per minute, to the high temperature furnace, at 1000° C., for 7 hours. Then, 30 g of carbide-derived carbon may be prepared by extracting Si from the carbon precursor using a thermochemical reaction. Since the carbide-derived carbon is nanoporous and has plate-like particles having an aspect ratio of about 1, the field emission layer 140 can be easily formed by inkjet printing using a dispersant. Alternatively, the field emission layer 140 may be formed by methods other than the inkjet printing. To obtain the carbide-derived carbon, the carbon precursor may be a carbide material selected from the group consisting of: a diamond-like carbide, such as, SiC or $B_4C$; a metal-like carbide, such as, TiC or $ZrC_x$; a salt-like carbide, such as $Al_4C_3$ or $CaC_2$; a complex carbide, such as, $Ti_xTa_yC$ or $Mo_xW_yC$; and a carbonitride, such as, $TiN_xC_y$ or $ZrN_xC_y$.

If the field emission layer 140 includes an oxidized porous silicon, the oxidized porous silicon may be an oxidized porous poly silicon or an oxidized porous amorphous silicon.

The field emission layer 140 may include BNBS. BNBS is an sp3-bounded 5H-BN, which is a material developed by the National Institute for Material Science (NIMS) and published on March, 2004. BNBS has a very stable structure and is one of the hardest materials next to diamond. BNBS has a high electron emission efficiency, is transparent in a visible wavelength range of approximately 380 to 780 nm, and has a negative electron affinity.

The operation of the inorganic light emitting display 100, constructed as described above, will now be explained. Various voltages can be applied between the first electrode 131 and the second electrode 132. For example, a direct current (DC), or an alternating current (AC), voltage can be applied between the first electrode 131 and the second electrode 132. When a strong electric field is formed, due to a voltage applied between the first electrode 131 and the second electrode 132, electrons supplied from the second electrode 132, which acts as a cathode, pass through the light emitting layer 115, such that light is emitted. Since the electrons are accelerated by the field emission layer 140 and then tunnel at high energy into the light emitting layer 115, the overall luminous efficiency can be improved, and a driving voltage applied to the first electrode 131 and the second electrode 132 can be significantly reduced. Also, when a strong electric field is formed, due to the voltage applied between the first electrode 131 and the second electrode 132, electrons trapped by the interface between the field emission layer 140 and the light emitting layer 115, in addition to the electrons supplied from the second electrode 132, are emitted and tunnel into the conduction band of the light emitting layer 115. Accordingly, the overall luminous efficiency can be improved, and a driving voltage applied to the first electrode 131 and the second electrode 132 can be reduced significantly.

The electrons, emitted to the conduction band of the light emitting layer 115, are accelerated by an external electric field, to obtain sufficient energy to excite a luminescent center, and then directly collide with the outermost electrons of the luminescent center, to excite the outermost electrons. When the excited electrons are stabilized to a ground state, visible light is emitted, due to the difference in energy between the excited state and the ground state. Some of the electrons having a high energy collide with a luminescent host, to ionize the luminescent host, thereby emitting secondary electrons. Some of the secondary electrons lose energy by colliding with the luminescent center. The excited electrons and the secondary electrons that do not collide with the luminescent center move into a high energy state, then excite the luminescent center, and are finally trapped in an interface of the first electrode 131.

When the light emitting layer 115 includes quantum dots, electrons are accelerated by the field emission layer 140, emitted at high energy into the light emitting layer 115, and collide with the quantum dots of the light emitting layer 115, thereby effectively exciting the electrons of the quantum dots. When the excited electrons are stabilized, visible light is produced. Accordingly, because of the properties of the quantum dots and the field emission layer 140, an overall luminous efficiency can be improved, and a driving voltage applied to the first electrode 131 and the second electrode 132 can be reduced.

Figure 4:
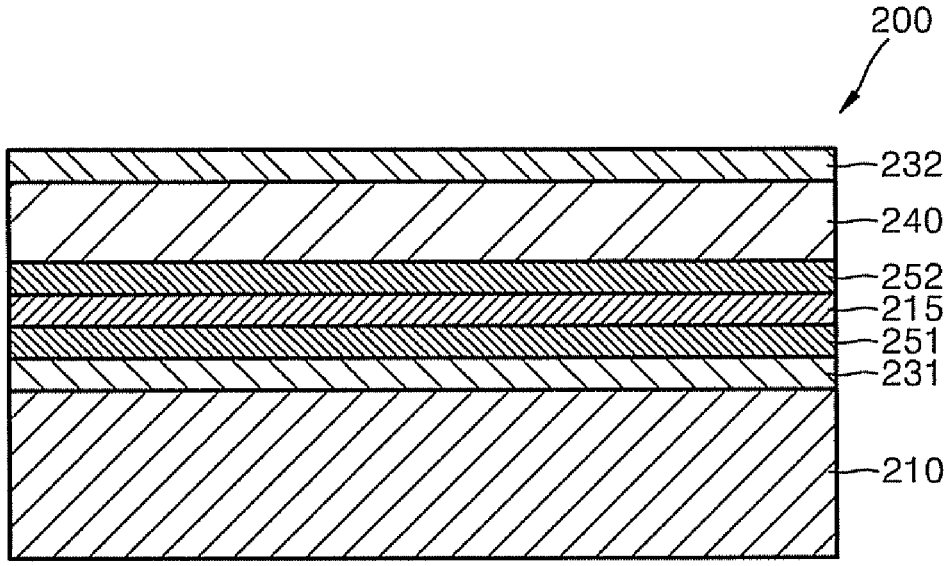
FIG. 4 is a cross-sectional view of a portion of an inorganic light emitting display, according to an exemplary embodiment of the present invention.

FIG. 4 is a cross-sectional view of a portion of an inorganic light emitting display 200, according to another exemplary embodiment of the present invention. Referring to FIG. 4, a first electrode 231 is disposed on a substrate 210, and a second electrode 232, facing the first electrode 231, is disposed on the first electrode 231. A light emitting layer 215 is disposed between the first electrode 231 and the second electrode 232. A first dielectric layer 251 is disposed between the first electrode 231 and the light emitting layer 215, and a second dielectric layer 252 is disposed between the second electrode 232 and the light emitting layer 215. The first dielectric layer 251 and the second dielectric layer 252 may be made of various materials, such as, silicon oxide or silicon nitride. A field emission layer 240 is disposed between the second electrode 232 and the second dielectric layer 252.

In the inorganic light emitting display 200 constructed as described above, when a strong electric field is formed, due to a voltage applied between the first electrode 231 and the second electrode 232, electrons supplied from the second electrode 232 (acting as a cathode) pass through the second dielectric layer 252 and then pass through the light emitting layer 215 to emit light. Since the electrons are accelerated by the field emission layer 240 and then tunnel at high energy into the light emitting layer 215, an overall luminous efficiency can be improved, and a driving voltage applied between the first electrode 231 and a second electrode 232 can be reduced significantly. Also, when the strong electric field is formed, due to the voltage applied between the first electrode 231 and the second electrode 232, electrons trapped by the interface between the field emission layer 240 and the second dielectric layer 252, in addition to the electrons emitted from the second electrode 232, are emitted and tunnel into the conduction band of the light emitting layer 215. Accordingly, the overall luminous efficiency can be improved, and a driving voltage applied between the first electrode 231 and the second electrode 232 can be reduced significantly.

Unlike the inorganic light emitting display 100, of FIG. 2, since the inorganic light emitting display 200 of FIG. 4 is configured such that the second dielectric layer 252 is interposed between the field emission layer 240 and the light emitting layer 215, a greater number of electrons can be trapped in an interface between the field emission layer 240 and the second dielectric layer 252. Accordingly, when the voltage is applied between the first electrode 231 and the second electrode 232, the greater number of electrons trapped, by the interface between the field emission layer 240 and the second dielectric layer 252, pass through the light emitting layer 215, thereby significantly increasing the luminous efficiency, at a low driving voltage.

Although a few embodiments of the present invention have been shown and described, it would be appreciated by those skilled in the art that changes may be made in this embodiment without departing from the principles and spirit of the present invention, the scope of which is defined in the claims and their equivalents.

What is claimed is:

1. An inorganic light emitting display, comprising:

a first electrode;

a second electrode disposed in opposition to the first electrode;

a light emitting layer comprising quantum dots, disposed between the first electrode and the second electrode; and a field emission layer comprising carbide-derived carbon, disposed between the light emitting layer and the second electrode, the field emission layer accelerating electrons supplied from the second electrode, wherein:

the field emission layer directly contacts the second electrode;

the light emitting layer directly contacts the field emission layer; and the first electrode directly contacts the light emitting layer.

2. The inorganic light emitting display of claim 1, wherein the first electrode is an anode and the second electrode is a cathode.

3. The inorganic light emitting display of claim 1, wherein the light emitting layer comprises an inorganic material.

4. The inorganic light emitting display of claim 1, wherein the field emission layer further includes an oxidized porous silicon, or a boron nitride bamboo shoot (BNBS).

5. The inorganic light emitting display of claim 1, wherein the carbide-derived carbon is formed using as a carbon precursor selected from the group consisting of a diamond-like carbide, a metal-like carbide, a salt-like carbide, a complex carbide, and a carbonitride.

6. The inorganic light emitting display of claim 5, wherein the diamond-like carbide comprises SiC or $B_4C$.

7. The inorganic light emitting display of claim 5, wherein the metal-like carbide comprises TiC or $ZrC_x$.

8. The inorganic light emitting display of claim 5, wherein the salt-like carbide comprises $Al_4C_3$ or $CaC_2$.

9. The inorganic light emitting display of claim 5, wherein the complex carbide comprises $Ti_xTa_yC$ or $Mo_xW_yC$.

10. The inorganic light emitting display of claim 5, wherein the carbonitride comprises $TiN_xC_y$ or $ZrN_xC_y$.

11. The inorganic light emitting display of claim 1, wherein the quantum dots comprise:

a CdSe core;

a ZnS shell surrounding the core; and trioctylphosphine oxide (TOPO) caps structurally supporting the core and the shell.

12. The inorganic light emitting display of claim 1, wherein the light emitting layer further comprises one selected from the group consisting of ZnS; SrS;

CaS; $CaGa_2S_4$,$SrGa_2S_4$, Mn, Ce, Tb, Eu, Tm, Er, Pr, and Pb.

* * * * *